US011526132B2

(12) United States Patent
Boaron et al.

(10) Patent No.: US 11,526,132 B2
(45) Date of Patent: Dec. 13, 2022

(54) SEALING SYSTEM FOR TIMEPIECE CASE

(71) Applicant: ROLEX SA, Geneva (CH)

(72) Inventors: Nicolas Boaron, Founex (CH); Jean-Baptiste Robin, Annemasse (FR)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 17/218,753

(22) Filed: Mar. 31, 2021

(65) Prior Publication Data

US 2021/0311435 A1 Oct. 7, 2021

(30) Foreign Application Priority Data

Apr. 3, 2020 (EP) ..... 20167902

(51) Int. Cl.
*G04B 37/08* (2006.01)

(52) U.S. Cl.
CPC ..... *G04B 37/084* (2013.01)

(58) Field of Classification Search
CPC ..... G04B 37/084; G04B 39/02; G04B 37/08; G04B 39/00; G04B 37/22; G04B 37/221; G04B 37/05; G04B 47/046; G04B 29/27; G04G 17/00
See application file for complete search history.

(56) References Cited

U.S. PATENT DOCUMENTS

| | | | | |
|---|---|---|---|---|
| 6,206,563 | B1 | 3/2001 | Dombre et al. | |
| 6,213,635 | B1 | 4/2001 | Savy et al. | |
| 6,406,178 | B1 * | 6/2002 | Luscher | G04B 37/0008 368/286 |
| 10,025,273 | B2 * | 7/2018 | Iguchi | G04B 37/0008 |
| 2009/0010111 | A1 | 1/2009 | Bertrand et al. | |

FOREIGN PATENT DOCUMENTS

| | | | |
|---|---|---|---|
| CH | 499818 | A | 7/1970 |
| CH | 1438471 | A4 | 1/1974 |
| EP | 0939351 | A1 | 9/1999 |
| EP | 1033633 | B1 | 10/2003 |
| EP | 1916576 | A1 | 4/2008 |

OTHER PUBLICATIONS

European Search Report dated Sep. 28, 2020, issued in counterpart EP application No. 20167902.4. (7 pages).

* cited by examiner

*Primary Examiner* — Edwin A. Leon
(74) *Attorney, Agent, or Firm* — WHDA, LLP

(57) ABSTRACT

A sealing system for a case of a timepiece, including: a first seal intended to be inserted between a middle on one side and a ring and a glass on the other side, a second seal intended to be inserted between a middle and a glass, the first and second seals being two distinct seals, in particular two independent seals or two separate seals, and/or the first and second seals being made of two distinct materials.

20 Claims, 7 Drawing Sheets

SEALING SYSTEM FOR TIMEPIECE CASE

This application claims priority of European Patent Application No. EP20167902.4, filed on Apr. 3, 2020, the contents of which is hereby incorporated by reference herein in its entirety.

The invention relates to a sealing system for a timepiece case. The invention relates also to a timepiece case comprising such a system. The invention also relates to a timepiece comprising such a system or such a case. The invention relates finally to a method for fitting such a timepiece or such a case.

The application EP1033633 relates to a device for tightly fixing a glass onto a watch case. The latter comprises an annular seal, which has a substantially I-shaped section with annular protuberances at each of its ends. A first protuberance is provided to be housed in an annular groove of a middle, while a second protuberance is provided to be housed in an annular groove of a glass. This seal is compressed by a bezel at each of its first and second protuberances, the latter being thus pressed into their respective groove.

The application EP1916576 describes a device for fixing a watch glass, the principle of which is similar to that of the device forming the subject of the application EP1033633. This device is, here, incorporated into water-resistant watch capable of being resistant at very great depths, typically between 3000 and 5000 meters, which has the particular feature of comprising, within it, a side wall provided to withstand the pressure forces encountered at such depths. This side wall can consist of a first ring housed in the middle of the watch, or even a wall of a back of the watch, and, provides, in all cases, a support for the glass. Thus, a seal of the glass fixing device, whose general structure is similar to that of the seal of the application EP1033633, is, here, disposed at the interface of the glass and of a second ring disposed on an annular seat of the middle, but also at the interface of the first ring or of a back and of the middle. The compression of this seal is, here, essentially provided by the second ring which acts as bezel according to the application EP1033633. FIG. 1 illustrates a sealing device known from the prior art, more particularly disclosed in the application EP1916576. This sealing device A10, incorporated in a case A100, comprises a seal A11 disposed at the interface of:

a middle A2, and a first ring A3 housed within the very middle A2 and provided to withstand pressure forces, and at the interface of:

a glass A4, and a second ring A5 disposed on an annular seat A21 of the middle, and which is provided to compress said seal A11 when it is fitted on the middle.

The application CH499818 discloses a glass fixing device implementing two O-ring seals disposed between a removable ring, a glass and a middle. It is specified in the description that these two seals are identical. The objective here is to propose a device provided for the fixing of a glass made of hardened mineral glass or of sapphire, which can guarantee the sealing of the watch case while being particularly compact in the plane, and thus allow the placement of a relatively narrow bezel on the case. Such seals are not provided to link the removable ring to the glass and a fortiori are not provided to link the ring-glass assembly to the middle. Moreover, the fact of employing two identical seals is limiting with respect to optimizing the sealing strength of the timepiece.

The aim of the invention is to provide a sealing system for a timepiece case or for a timepiece that makes it possible to remedy the abovementioned drawbacks and improve the sealing systems known from the prior art. In particular, the invention proposes a sealing system that makes it possible to optimize the sealing of a timepiece case.

A sealing system for a timepiece case according to the invention is defined by claim 1.

Different embodiments of the system are defined by claims 2 to 8.

A timepiece case according to the invention is defined by claim 9.

Different embodiments of a timepiece case are defined by claims 10 and 11.

A timepiece according to the invention is defined by claim 12.

A method for fitting a timepiece case or a timepiece is defined by claim 13.

The attached drawings represent, by way of examples, two embodiments of a timepiece according to the invention.

Figure 4A:
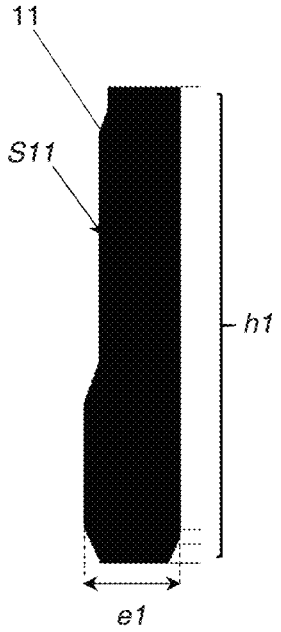
Figure 4B:
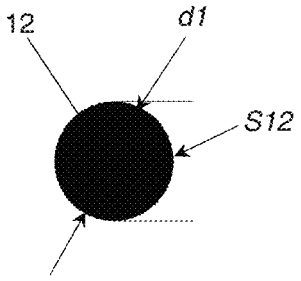

FIGS. 4*a* and 4*b* are views in radial cross-section of the first embodiment of the sealing system FIGS. 5*a* to 5*e* are views in partial radial cross-section of the first embodiment of a timepiece illustrating a fitting method for the first embodiment of a timepiece.

Figure 6:
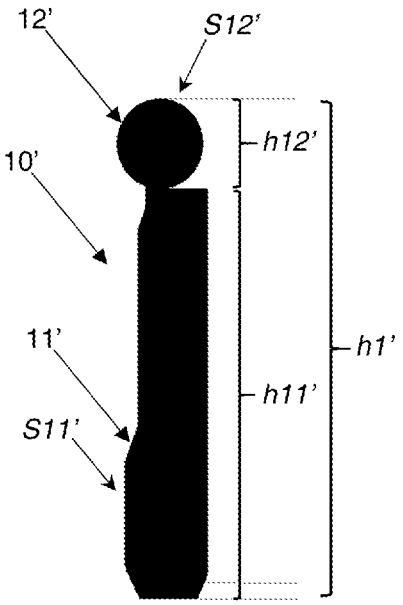

FIG. 6 is a view in radial cross-section of a second embodiment of the sealing system.

Figure 7:
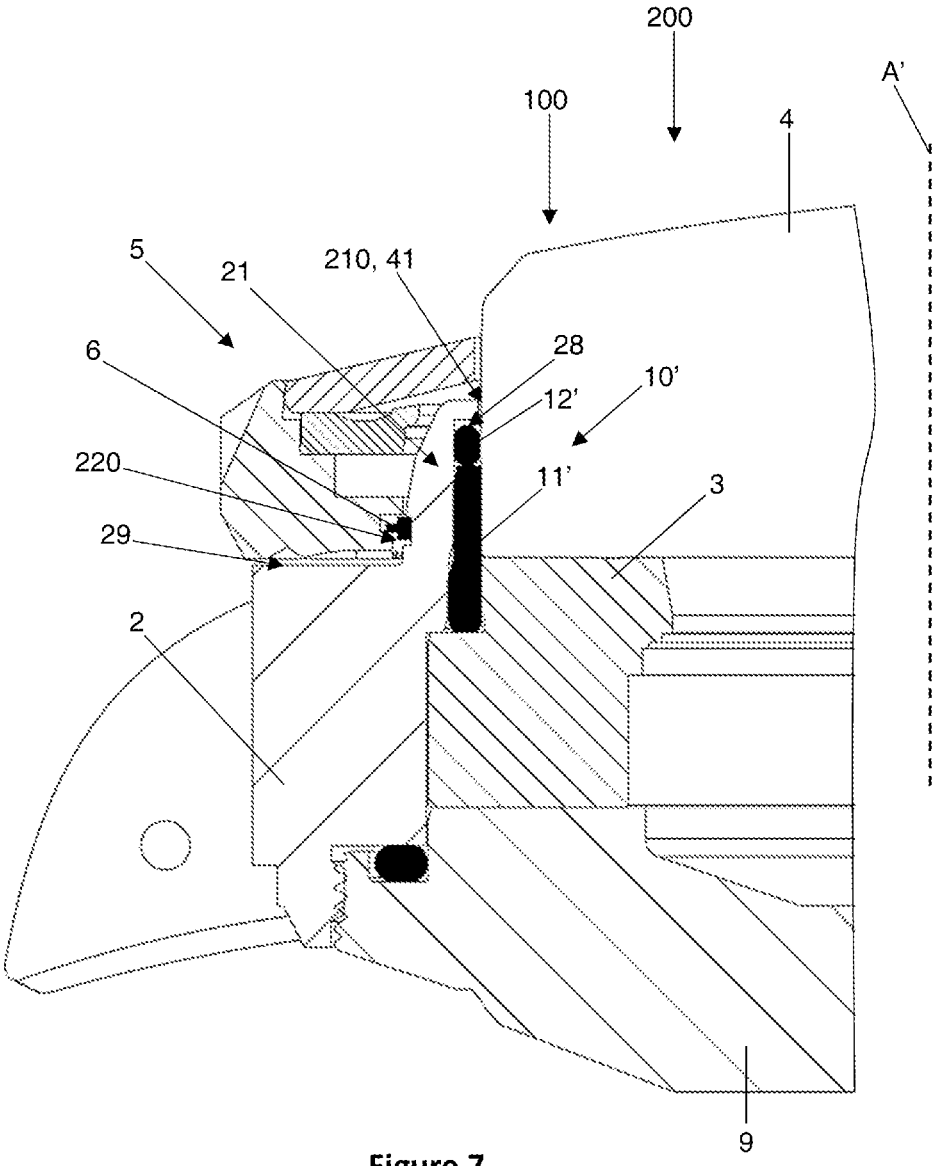

FIG. 7 is a view in radial cross-section of a second embodiment of a timepiece.

A first embodiment of a timepiece 200 is described hereinbelow with reference to FIGS. 2 to 5.

The timepiece is, for example, a watch, in particular a wristwatch.

The timepiece preferably comprises a timepiece case 100. The timepiece further comprises a horological movement. The horological movement is intended to be fitted in the watch case in order to protect it from the outside environment.

The horological movement can be an electronic movement or a mechanical movement, notably an automatic movement.

The watch case 100 comprises a middle 2, a first ring 3, a glass 4 and a sealing system 10. The watch case also comprises a back 9 and a bezel 5, notably a rotating bezel.

The first ring 3 is assembled in the middle 2, notably housed with little play just in contact with a shoulder of the middle. It notably allows for the casing of the movement.

The back 9 is fixed to the middle, notably by screwing. Preferably, the back is screwed until it comes into abutment against the ring 3.

The glass 4 is, also, fixed to the middle, notably by the action of the sealing system. The glass is preferably fixed in contact against the first ring 3.

The bezel can be fixedly fitted on the middle. Alternatively, the bezel can be a rotating bezel, that is to say fitted so as to be movable in rotation on the middle 2 about an axis A.

The sealing system 10 comprises:

a first seal 11 intended to be inserted between:

on one side, the middle 2, and, on the other side, the first ring 3 and the glass 4, and a second seal 12 intended to be inserted between the middle 2 and the glass 4.

Figure 1:
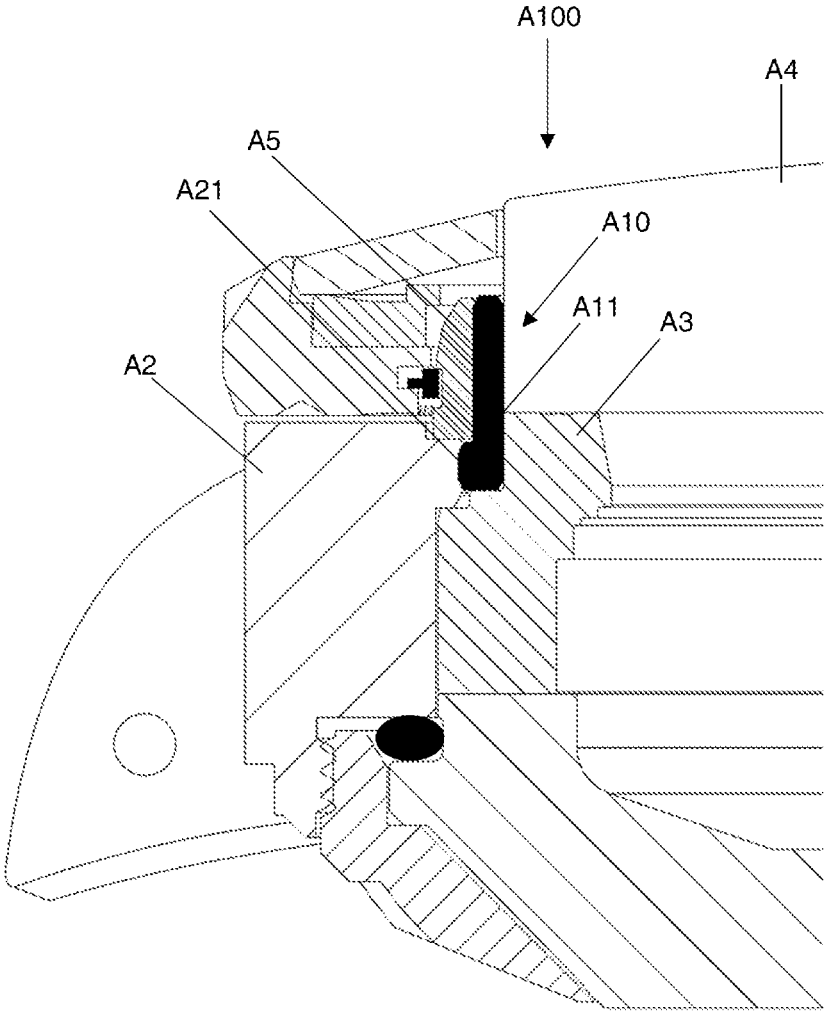
FIG. 1 is a view in radial cross-section of an embodiment of a timepiece known from the prior art.
Figure 2:
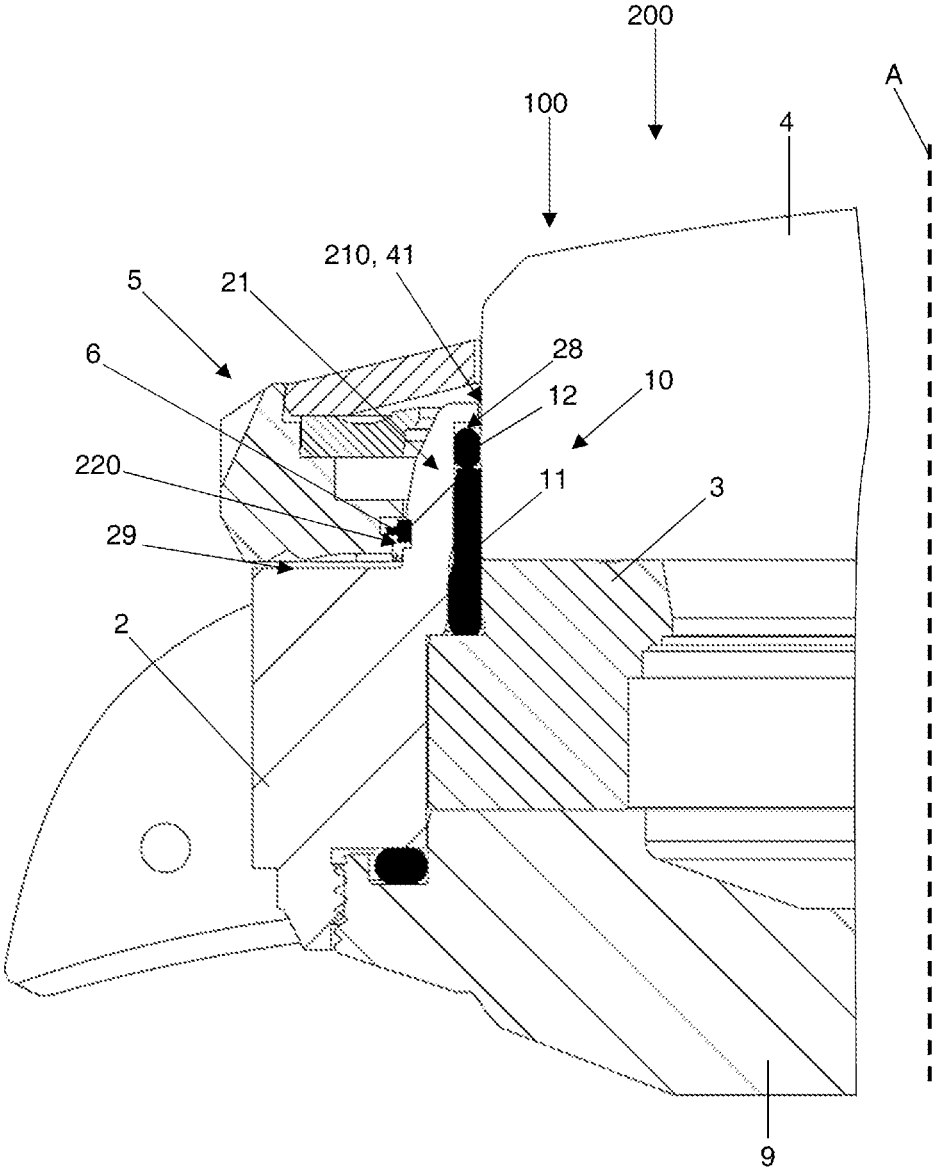
FIG. 2 is a view in radial cross-section of a first embodiment of a timepiece.

In the timepiece case represented in FIG. 2, the first seal 11 is inserted between the middle 2 on one side and the first ring 3 and the glass 4 on the other side, and the second seal 12 is inserted between the middle 2 and the glass 4. These insertions are radial, that is to say that, over a first part of the height of the first seal (measured according to the axis A and referenced h4 in FIG. 3), the progression is from the glass to the first seal, then from the first seal to the middle moving at right angles to the axis A toward the outside of the middle and, over a second part of the height of the first seal (measured according to the axis A and referenced h3 in FIG. 3), the progression is from the first ring to the first seal, then from the first seal to the middle moving at right angles to the axis A toward the outside of the middle. Moving parallel to the axis A, preferably no such transitions are noted. Moreover, over the entire height of the second seal (measured according to the axis A), the progression is from the glass to the second seal, then from the second seal to the middle moving at right angles to the axis A toward the outside of the middle.

In this first embodiment, illustrated by FIGS. 2, 3, 4*a* and 4*b*, the sealing device 10 comprises two distinct seals 11, 12.

The first seal 11 comprises a substantially I-shaped or L-shaped radial section of height h1 and of greater thickness e1 as represented in FIG. 4*a*, this height and this thickness being measured in the non-deformed state of the first seal. The first seal 11 is positioned bearing against the first ring 3 over a height h3 corresponding notably to a depth defined by a shoulder 31 of the first ring 3. The first seal 11 is also positioned against the glass 4 over a height h4 corresponding partially to the height h of the glass 4.

Preferably, the first seal has an annular form.

Preferentially, the ratio h1/e1 is between 3 and 10, even between 4 and 8. More preferentially, this seal is manufactured in a first material chosen from among the thermoplastic polyamides, such as nylon and notably zytel or hytrel. The first seal 11 can be a component of revolution, notably of revolution of axis A.

Preferably, the first seal 11 is configured so as to mechanically link, on its own, the glass 4 to the middle 2 and/or the ring 3 to the middle 2. This link is made possible by the compression of the first seal which induces a pressing of the first seal on the middle, on the first ring and on the glass at the contact surfaces with the first seal. This pressing associated with the friction coefficient that exists at the contact surfaces of the first seal and of the different parts creates a force holding the various parts (glass, ring, middle and first seal) in position. The mechanical link of the glass to the middle and/or the ring to the middle is therefore ensured by friction.

The second seal 12, for its part, takes the form of a seal comprising a radial section whose area S12 is smaller, even much smaller, than the area S11 of the I-shaped or L-shaped radial section of the first seal 11. Preferentially, the ratio S12/S11 is less than 0.4, even less than 0.3, even less than 0.2. This ratio is determined when the seals are not deformed.

Preferably, the second seal has an annular form.

The second seal 12 can be an O-ring seal of diameter (radial section) d1. The diameter d1 is preferentially between 0.5 mm and 1.5 mm. Alternatively, the second seal 12 can have a non-circular section. For example, the second seal can be a four-lobe seal. Also alternatively, the second seal can comprise a lip. Preferentially, the second seal is manufactured in a second material chosen from among the elastomers, such as FKM. The second seal 12 can be a component of revolution, notably of revolution about the axis A.

Thus, the first and second materials are advantageously distinct.

The second seal is configured so as to ensure the sealing of the case 100 of the timepiece 200 at the glass, notably at a glass-middle interface. This sealing is, for example, an alternative to or complements that ensured by the first seal. In other words, the second seal does not ensure the function of fixing or of mechanical linking. In this sense, the second seal is provided exclusively to guarantee the sealing of the case 100 of the timepiece 200 at the glass, notably at a glass-middle interface.

A second embodiment of a timepiece 200 is described hereinbelow with reference to FIGS. 6 and 7.

The second embodiment differs from the first embodiment in that the sealing system comprises a seal packing 10' manufactured in a single piece. Preferably, the latter comprises a first portion forming the first seal 11' at a first end, notably at a bottom end of the packing, and a second portion forming the second seal 12' at a second end, notably at a top end of the packing. The first portion 11' comprises a slender radial section of height h11', while the second portion 12' has the form of a lobe comprising a section of substantially oval or rounded form of a height h12', the heights h11' and h12' being determined in a non-deformed state of the packing. Preferentially, the ratio h11'/h12' is between 4 and 6. More preferentially, the ratio S12'/S11' is less than 0.4, even less than 0.3, even less than 0.2, with S11' and S12' the respective areas of the radial sections of the portions 11',12'. This ratio is determined when the portions are not deformed.

Alternatively, the second portion 12' can have a non-circular radial section. For example, it can be elliptical. Again alternatively, this second portion can comprise a lip.

Advantageously, the first portion 11' can be made from a first material and the second portion 12' can be made from a second material. For example, an overmolding could be performed on the first portion or the second portion so as to obtain the distinct first and second materials.

Preferentially, this packing is a component of revolution, notably of revolution of axis A'.

This system 10' is incorporated in a case 100 exactly in the same way as the device 10. FIG. 7 represents such a device 10' incorporated in a case 100. It will be noted that FIG. 7 is very similar to FIG. 2.

Whatever the embodiment or variant, the middle advantageously comprises a chimney 21 protruding from a top face 29 of the middle. Preferably, the chimney comprises a rim 210 closing off a housing 28 for receiving the first seal and/or the second seal formed in the middle. Preferably, the chimney is arranged to extend around the glass. The chimney is preferably arranged to extend over a part of the thickness of the glass.

The chimney 21 of the middle 2 can be provided to fulfill other functions, such as, for example, a function of assembly of the bezel 5 on the middle 2. For that, the chimney can, for example, comprise a groove 220 provided to receive an axial retaining ring 6 for the bezel 5. This bezel 5 can be a rotating bezel or not. The chimney 21 of the middle 2 can also be provided to limit the displacement of the glass with respect to the middle, in particular in the event of radial impact on the case 100.

Preferably, the chimney is formed as a monobloc or single-piece part or made from the same material with the rest of the middle.

Whatever the embodiment or variant, the ring 3 advantageously comprises a flange or forms a flange.

The ring 3 is, here, provided to absorb pressure forces from the glass 4, and possibly from the back 9. This ring 3 can, in addition or alternatively, serve as decorative or display element for a time or time difference indication. The ring 3 can thus be likened to a flange. In the variant embodiment of case represented in FIG. 2 or 7, the ring 3 is distinct from a back 9. Alternatively, the ring 3 can form part of the case back.

Thus, whatever the embodiment or variant, the ring 3 can comprise or form the back.

Whatever the embodiment or variant, unless stipulated otherwise, the forms and dimensions described for the seals are the forms and dimensions of the seals in their non-deformed states.

One way of executing a method for fitting the case 100 of the timepiece 200 or a timepiece 200 is described hereinbelow with reference to FIGS. 5*a* to 5*e*. The method comprises the following steps:

placing the first seal 11, 11' and the second seal 12, 12' on an assembly formed by the ring 3 and the glass 4, sliding the middle 2 over the assembly obtained in the preceding step.

A more detailed description of a way of executing the method is provided hereinbelow.

Figure 5A:
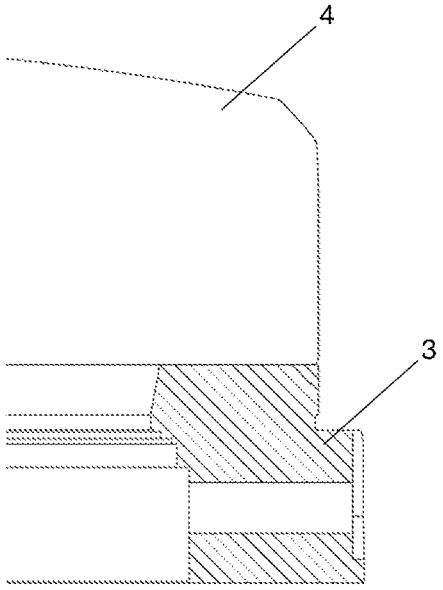

In a first step, illustrated by FIG. 5*a*, the glass 4 is disposed on the first ring 3.

Figure 5B:
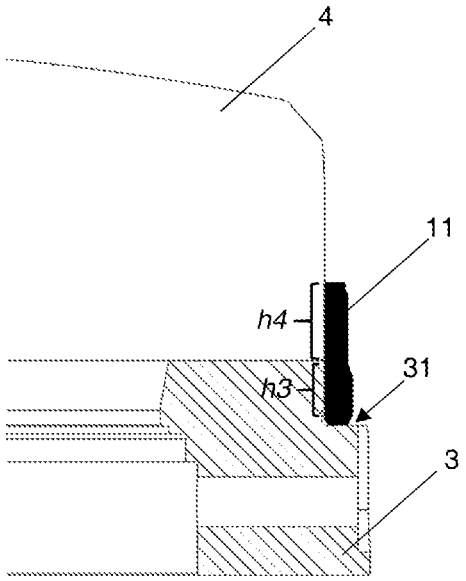

In a second step, illustrated by FIG. 5*b*, the first seal 11 is driven onto the glass 4 and the first ring 3, abutting against a shoulder 31 of the first ring 3.

Figure 5C:
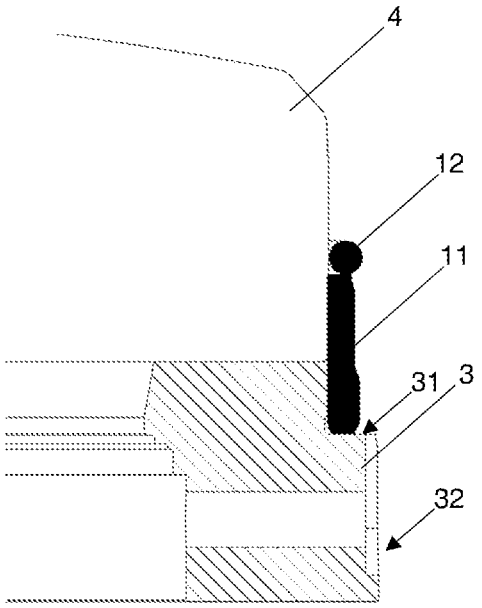

In a third step, illustrated by FIG. 5*c*, the second seal 12 is placed onto the glass 4, abutting against the first seal 11.

Preferentially, the first ring 3 comprises a cutout 32 so as to receive an end of a tube 7 which is itself provided to receive a crown and a rod, not represented in the drawings. Advantageously, this cutout 32 can serve as foolproofing means and/or positioning element, in particular as element of angular orientation of the ring 3 in the middle 2.

Figure 3:
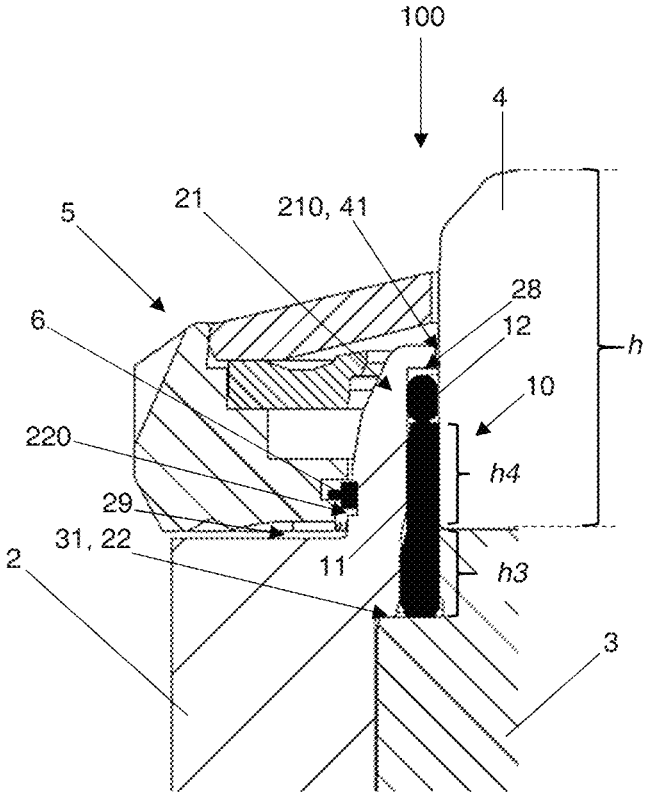
FIG. 3 is a view in partial radial cross-section of the first embodiment of a timepiece.
Figure 5D:
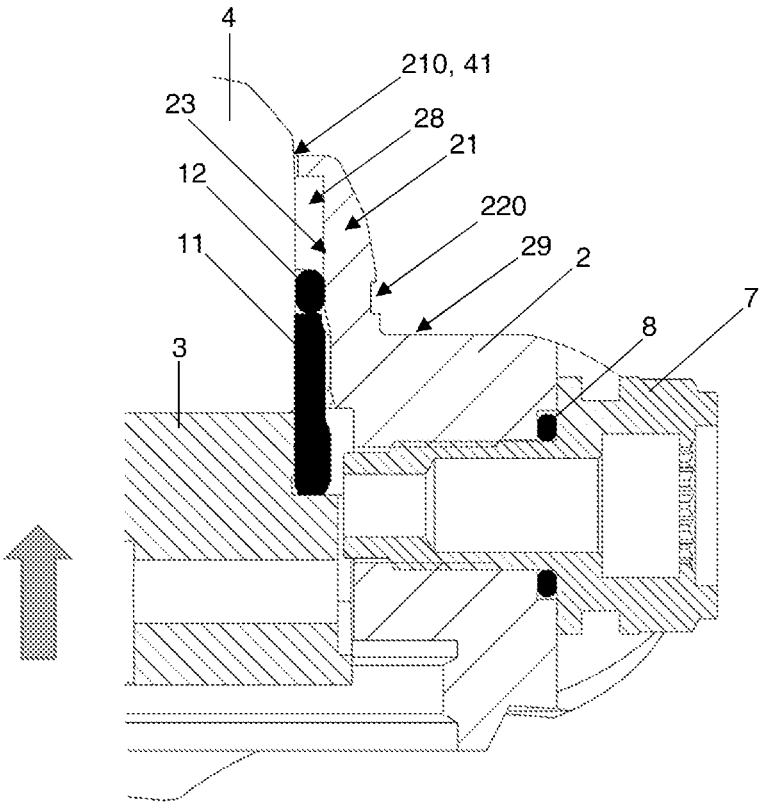

In a fourth step illustrated in FIG. 5*d*, the assembly of the components 3, 4, 11, 12 is inserted into the middle 2 until the shoulder 31 of the first ring 3 comes into abutment against a step 22 of the middle 2 (more particularly visible in FIG. 3).

Figure 5E:
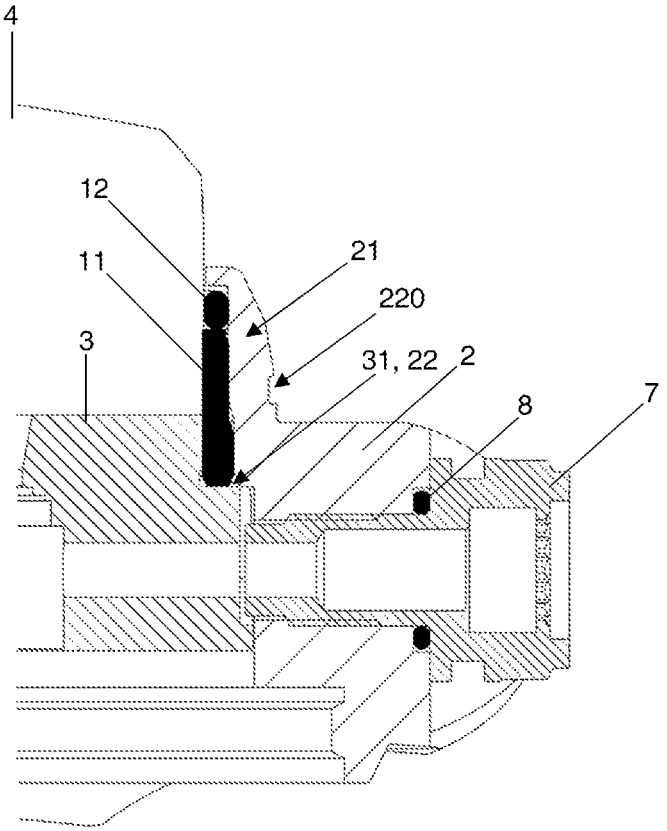

Once the assembly of the components 3, 4, 11, 12 is thus disposed in the middle 2, as illustrated by FIG. 5*e*, the system 10 forms a sealing system of the case 100 at the glass 4, notably at the interface between the middle 2 and the glass 4, and a fortiori at the interface between the first ring 3 and the middle 2.

Throughout this document, "radial section" is understood to mean a section extending in a plane:

passing through an axis of the seal, and at right angles to a plane on which the seal extends.

The axis is, for example, an axis of revolution.

The solutions of the sealing system 10 described above preferably offer the particular feature of comprising a first seal notably ensuring the fixing of a glass 4 in the case 100, and a second seal provided exclusively to guarantee the sealing of the case at the glass, notably at the interface of the glass 4 and of a middle 2 of the case 100, and at the interface of the middle 2 and of a first ring 3 housed in the very middle 2 and provided to withstand the pressure forces.

Advantageously, the first seal is provided to link, on its own, the glass 4 to the first ring 3, and a fortiori to the middle 2, on the other side, the second seal has characteristics that are quite distinct from those of the first seal in order to best fulfill its function of making the case 100 water-resistant at the glass 4, and notably its function of providing sealing at the interface zone between the glass 4 and the middle 2, and a fortiori its function of providing sealing at the interface zone between the middle 2 and the first ring 3.

More particularly, studies carried out by the applicant have shown that such a second seal provides a significant gain in a "static" sealing, but also makes it possible to guarantee a "dynamic" sealing during or after a significant impact if one of the elements at the glass had been displaced.

The solutions described offer the particular feature of comprising two seals disposed between the middle and the glass. The first seal advantageously contributes to the fixing of the glass onto the middle. The first seal can also serve as anti-extrusion ring, in particular at very great depths. The second seal is, for its part, provided exclusively to guarantee the sealing of the case at the glass, in particular at very great depths. Advantageously, these two seals have quite different characteristics, notably different stiffness characteristics, so as to best ensure their respective functions. For that purpose, the first and second seals can, for example, be manufactured in materials having different characteristics, in particular different elasticity moduli.

Advantageously, a sealing system according to the invention is incorporated in a case design which is configured so as to minimize the number of zones to be made water-resistant at the glass, namely just one and the same zone to be made water-resistant at the glass. Thus, a sealing system incorporated in such a case design makes it possible to guarantee an optimal sealing at the glass of said case, notably at very great depths, typically greater than 5000 meters.

In the various embodiments of the sealing system, the first and second seals are distinct. Thus, depending on the embodiments, it is possible to distinguish the two seals from each other by one or more of their different mechanical and/or physical-chemical and/or geometrical features.

For example, in an embodiment, it is possible to distinguish the two seals from each other because they are independent, i.e. formed by two separate parts or two parts without a mechanical link between them.

In another embodiment, it is possible to distinguish the two seals from each other because they are made of two distinct or different materials or they include two distinct or different materials. This may also be the case although both seals are made in one and a single part.

In another embodiment, it is possible to distinguish the two seals from each other because, although made in one and a single part, it is possible to identify an area of the whole part with a particular geometry. For example, the particular geometry may be a reduced cross section (perpendicularly to axis A or A') of the whole part creating a boundary between the first and second seals. For example, the reduced cross section has an area lower than 30% or 20% or 10% of the maximum area of a cross section of the part.

These various distinguishing criteria can be combined.

The invention claimed is:

1. A sealing system for a case of a timepiece, comprising:

a first seal intended to be inserted between a middle on one side and a ring and a glass on the other side, a second seal intended to be inserted between a middle and a glass, the first and second seals being two distinct seals, including two independent seals or two separate seals, and/or the first and second seals being made of two distinct materials.

2. The sealing system as claimed in claim 1, wherein the second seal comprises a radial section whose area S12 is smaller than the area S11 of the radial section of the first seal, the ratio S12/S11 being less than 0.4, the areas being determined in a non-deformed state of the seals.

3. The sealing system as claimed in claim 1, wherein the second seal has a circular radial section, notably with a circle diameter of between 0.5 mm and 1.5 mm, the form of the section and/or the diameter being determined in a non-deformed state of the second seal, and/or wherein the second seal is configured so as to exclusively ensure the sealing of a case of a timepiece, at a glass, notably at a glass-middle interface, as an alternative to or complementing the first seal.

4. The sealing system as claimed in claim 1, wherein the first seal has an I-shaped or L-shaped radial section and/or wherein the first seal is configured so as to mechanically link on its own a glass to a middle and/or a ring to a middle.

5. The sealing system as claimed in claim 1, wherein the first seal has a height h1 and a greater thickness e1, the ratio h1/e1 being between 3 and 10, the height and thickness being determined in a non-deformed state of the first seal.

6. The sealing system as claimed in claim 1, wherein the first seal is manufactured in a material chosen from among thermoplastic polyamides.

7. The sealing system as claimed in claim 1, wherein the second seal is manufactured in a material chosen from among the elastomers.

8. The sealing system as claimed in claim 1, wherein the first and second seals are produced in the form of one and the same seal packing comprising a first portion forming the first seal, notably at a first end of the packing, and a second portion forming the second seal, notably at a second end of the packing.

9. A case of a timepiece comprising:

a middle, a ring, a glass, and the sealing system as claimed in claim 1.

10. The case of a timepiece as claimed in claim 9, wherein the middle comprises a chimney protruding from a top face of the middle or wherein the middle comprises a chimney protruding from a top face of the middle and the chimney comprises a rim for closing a housing for receiving the first seal and/or the second seal formed in the middle.

11. The case of a timepiece as claimed in claim 9, wherein the ring comprises a flange and/or wherein the ring comprises a bottom.

12. A timepiece comprising the sealing system as claimed in claim 1.

13. A method for fitting the case of a timepiece as claimed in claim 9, comprising the following steps:

placing the first seal and the second seal on a ring and glass assembly, sliding the middle over the assembly obtained in the preceding step.

14. The sealing system as claimed in claim 1, wherein the ratio S12/S11 is less than 0.3.

15. The sealing system as claimed in claim 1, wherein the ratio S12/S11 is less than 0.2.

16. The sealing system as claimed in claim 5, wherein the ratio h1/e1 is between 4 and 8.

17. The sealing system as claimed in claim 6, wherein the first seal is manufactured in a material chosen from among thermoplastic polyamides from the group consisting of nylon, zytel and hytrel.

18. The sealing system as claimed in claim 1, wherein the second seal is manufactured from a fluoroelastomer FKM.

19. A timepiece comprising the case as claimed in claim 9.

20. A method for fitting the timepiece as claimed in claim 12, comprising the following steps:

placing the first seal and the second seal on a ring and glass assembly, sliding the middle over the assembly obtained in the preceding step.

* * * * *